US005112006A

United States Patent [19]

Palmer

[11] Patent Number: 5,112,006

[45] Date of Patent: May 12, 1992

[54] SELF DEFENSE MISSILE

[75] Inventor: John P. Palmer, Seattle, Wash.

[73] Assignee: The Boeing Company, Seattle, Wash.

[21] Appl. No.: 557,560

[22] Filed: Mar. 12, 1975

[51] Int. Cl.[5] ..... F41G 7/20

[52] U.S. Cl. ..... 244/3.16; 244/3.28

[58] Field of Search ..... 102/70.2 P; 244/3.16

[56] References Cited

U.S. PATENT DOCUMENTS 3,150,848 9/1964 Lager ..... 244/3.16

3,827,656 8/1974 Dettling et al. ..... 244/3.16

3,848,830 11/1974 Born ..... 244/3.16

*Primary Examiner*—Michael J. Carone

*Attorney, Agent, or Firm*—J. Peter Mohn

[57] ABSTRACT

A self defense missile, for bombers in particular, wherein the slower flying bomber is being overtaken by a faster flying hostile aircraft in the rear quadrant. The self defense missile is an unpowered missile having wings to provide lift, a guidance system to control the direction of flight of the missile, and a homing detection in the tail of the missile to cause the missile to fly into the path of the hostile aircraft. In operation, the self defense missile is launched parallel to the direction of flight of the bomber. As the missile slows down, the wings give it lift to keep it at the appropriate altitude. The homing detector in the tail guides on the approaching hostile aircraft and the guidance system keeps the self defense missile on a collision course. This action by the self defense missile and the increasing speed of closing caused by the slowing of the missile, forces the hostile aircraft to break off pursuit to take evasive action of face destruction upon intercept when the self defense missile is overtaken.

5 Claims, 3 Drawing Sheets

Fig. 1A
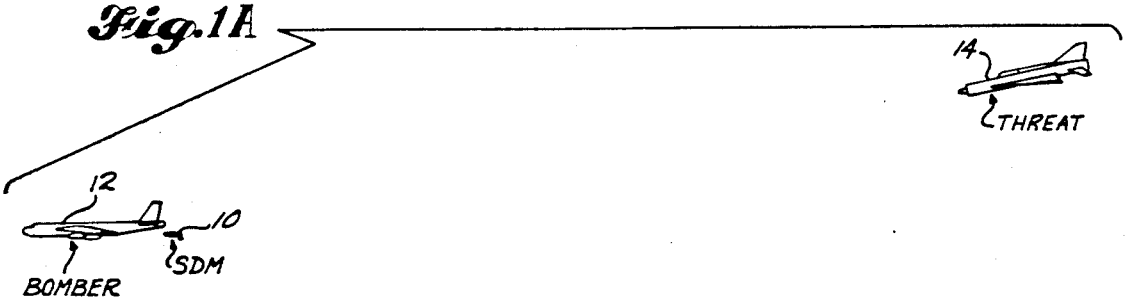
Fig. 1B
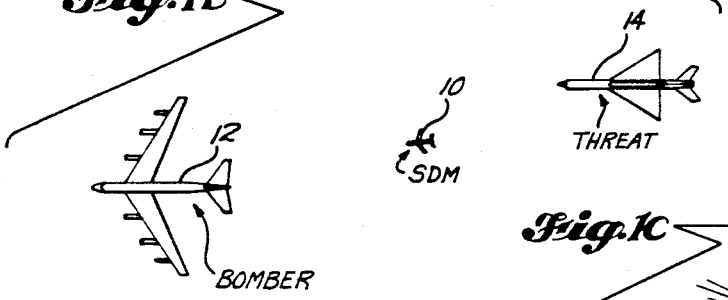
Fig. 1C
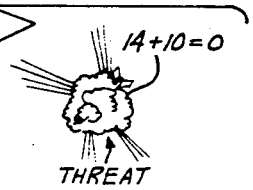
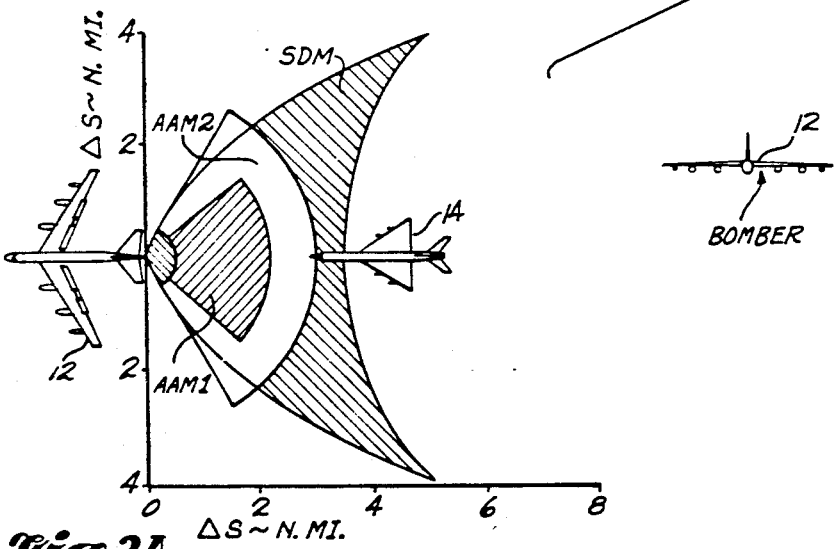
Fig. 2A
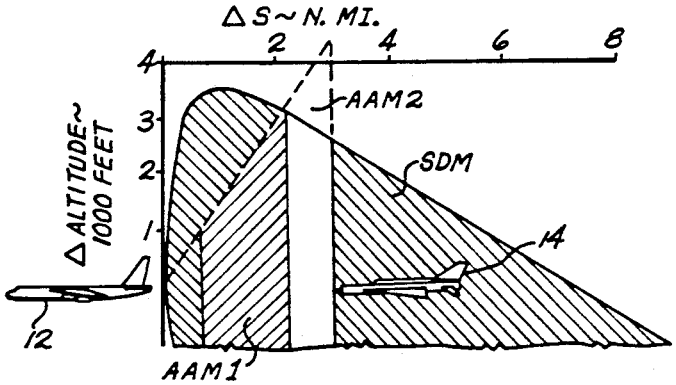
Fig. 2B

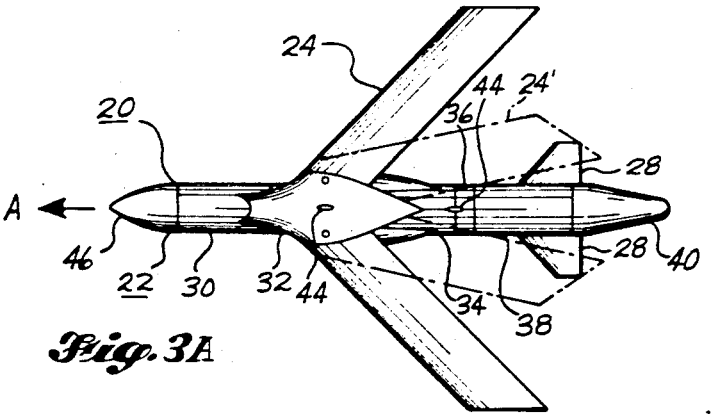
Fig. 3A
Fig. 3B
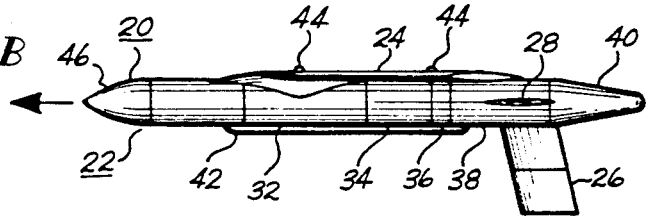
Fig. 3C
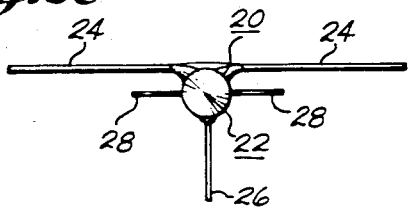
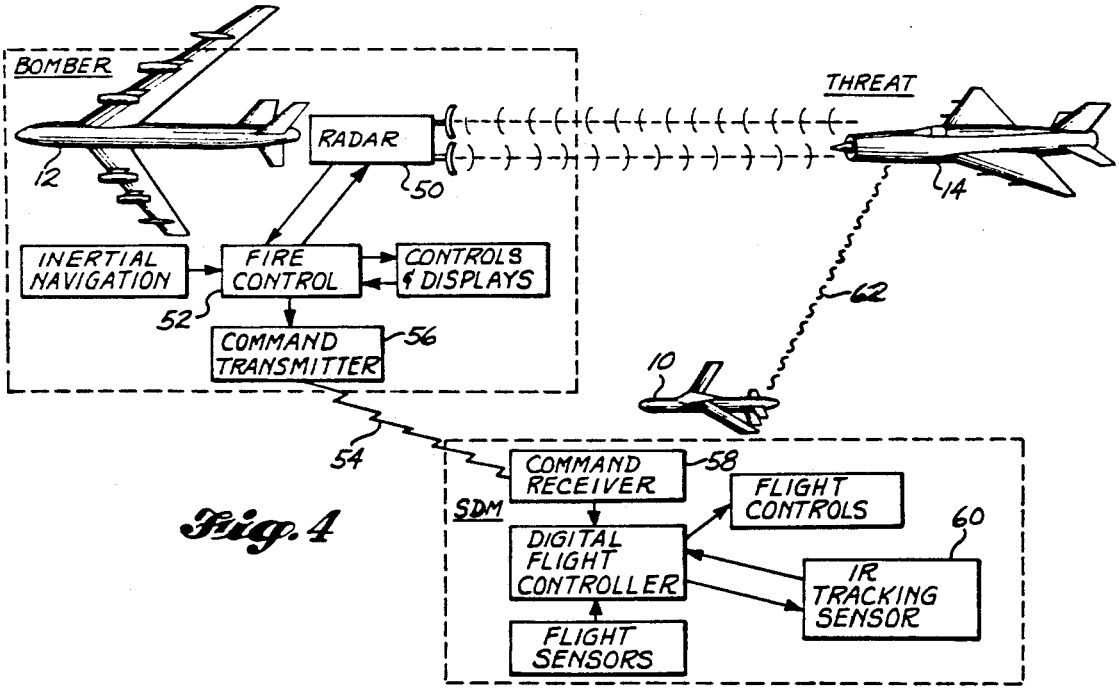
Fig. 4

SELF DEFENSE MISSILE

BACKGROUND OF THE INVENTION

1. Field of the Invention

Relates to air-to-air missiles and more particularly to air-to-air missiles having homing devices and guidance systems to direct the missile to the target.

2. Discussion of the Problem to be Solves and the Prior Art

To penetrate enemy territory, a bomber must fly at low altitudes and utilize electronic counter measures (ECM) to reduce the effectiveness of radar detection and tracking. There is no active defense other than a radar-directed tail gun system. The effectiveness of the gun has been demonstrated in Southeast Asia, where two interceptors were destroyed without corresponding loss of bombers. Unfortunately, at low altitudes, the gun has questionable fire control radar performance and the bomber is reduced to a passive, undefended target. Once an interceptor succeeds in gaining visual or infrared contact, he may proceed virtually without interference to an optimum weapon launching position.

The most critical attack area for a bomber is the rear quadrant, particularly with infrared guided missiles. The higher closing velocities and line-of-sight rates from the front and side quadrants will significantly reduce missile kill probabilities. Typical launch envelopes for a Mach 0.9 interceptor against a bomber are 2.2 nautical miles (n.m.) over $\pm 45°$ tail aspect angle, or for a more advanced infrared guided weapon 3.0 n.m. over a $\pm 60°$ aximuthal sector.

To offset bomber vulnerability, a number of defense missiles have been proposed. The major problem has been getting these missiles turned into the rear quadrant. They must be either launched forward and turned 180° after launch, or launched to the rear with an awkward stability transition through zero speed. In order to execute these maneuvers and retain rear quadrant range, some of the resultant missiles have been as large as offensive missiles which impacts the bomber's offensive payload. These missiles inherently have greater performance in the front and side quadrants and have been matched with fire control radars to exploit the full missile capability. As a result, the threat detection, fire control, and missile guidance systems have become inordinately complex, sophisticated and costly.

The proposed Self Defense Missile (SDM) concept is based on the premise of protecting the critical rear quadrant. The concept employs unpowered missiles which are released from the bomber and fly a nominal mid-course trajectory based on threat position and velocity at time of launch.

The threat detection and tracking is accomplished using a radar which has been designed for low altitude operation and is modified for the SDM application to provide increased angle accuracy.

The SDM mid-course is intermittantly revised by the fire control system to counter changes in the threat trajectory. An infrared (IR) seeker or the like at the aft end of the SDM is utilized for the terminal guidance. The IR seeker locks-on after launch. The bomber fire control system transmits IR seeker aiming information to reduce the IR search volume and to enhance target acquisition.

The SDM concept provides a minimum impact defense system since a new threat detection system is not required. The terminal guidance seeker technology and hardware are currently available which reduces the SDM development. The fire control system is greatly simplified, since angle accuracy and data rate requirements are minimal and coverage is limited to the rear. All of these factors combine to significantly reduce the cost of the SDM as compared to other missile defense systems.

In addition, the unpowered Self Defense Missile concept has some unique advantages over other approaches to the self defense problem. The control system is simplified since the missile does not have to execute a 180 degree turn. The lack of a propulsion system significantly reduces the missile size, eliminates at least one-fifth of the expense and complexity, and also makes both ends of the missile available for sensors and antennas. Compared to powered missiles, installation of the SDM on a bomber allows more missiles to be carried for the same weight. The missile environment for the sensors and guidance and control components is less demanding in terms of 'g' loads, vibration, and heating. Without a rocket propulsion system, the storage, handling, reliability and safety are improved. Due to the small size and lack of propulsion system smoke and heat, the optical, radar and I.R. visibility will be very low, thereby minimizing the chance for enemy detection of this defense concept.

DESCRIPTION OF THE DRAWINGS

FIGS. 1A, 1B, and 1C are a brief representation of the SDM concept.

FIGS. 2A and 2B depict the effective ranges of air-to-air missiles including the SDM.

FIGS. 3A, 3B, and 3C are top, side, and end views of the preferred embodiment of the SDM missile itself.

FIGS. 4 depicts the baseline guidance and control concept of the SDM.

DESCRIPTION OF THE PREFERRED EMBODIMENT

Figure 5:
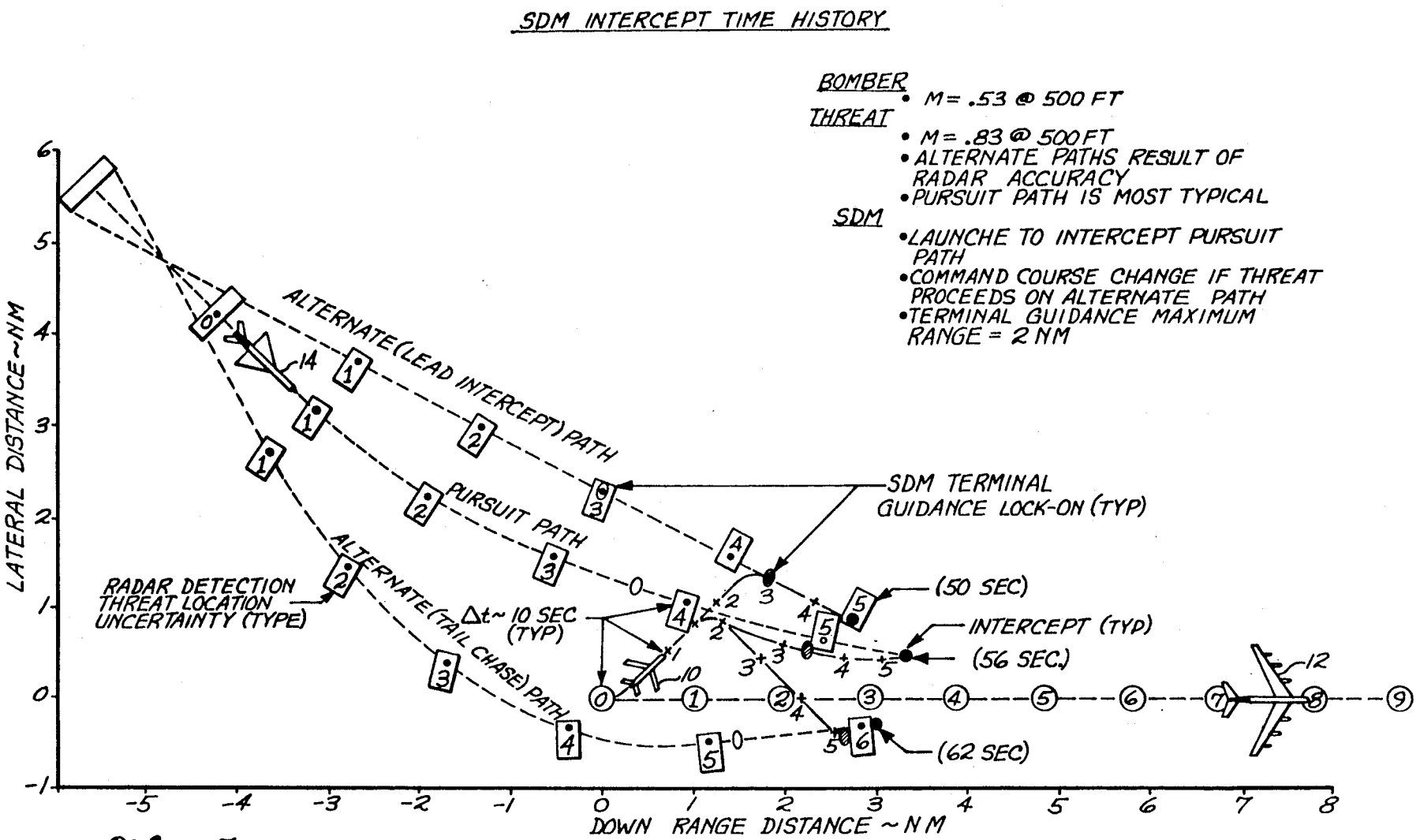
FIG. 5 is an SDM intercept time history.

The unpowered self defense missile (SDM) concept is shown simply in FIGS. 1A, 1B, and 1C. Following threat detection, the SDM 10 is released from the defending aircraft 12. The SDM 10 decelerates and maneuvers onto a collision course to intercept the threat aircraft 14. The defending aircraft 12 is free to maneuver or take other evasive action after the SDM 10 has been launched.

FIGS. 2A and 2B depict the reasoning behind the SDM concept. Again, as in FIGS. 1A, 1B and 1C, the defending aircraft 10 is pursued by the overtaking threat aircraft 14 in the rear quadrant. While FIGS. 2A and 2B are not to scale, they represent the facts of air-to-air missile combat. Areas AAM1 and AAM2 represent the effective range of known typical air-to-air offensive missiles which might be launched by threat aircraft 14 against defending aircraft 10. If threat aircraft 14 can be kept from entering the zone of effectiveness of its offensive missiles, defending aircraft 10 is safe. Conventional, small, powered, air-to-air defensive missiles cannot accomplish this task sufficiently. By replacing the conventional air-to-air defensive missile with an unpowered SDM having lift capability, the range is increased to the shaded area labeled SDM allowing the threat aircraft 14 to be destroyed or made to break off pursuit prior to getting within range of its offensive weapons.

Another important consideration with the SDM concept is its duration of influence. When a defensive, conventional, powered air-to-air missile is fired it may reach terminal speeds approaching Mach 3. Thus, the speed of closing to an offensive missile might be Mach 5 to Mach 6. Correspondingly, the speed of closing between the same defensive missile and the threat aircraft might be Mach 3 to Mach 4. Such a defensive missile poses only a brief threat to be overcome by a momentary evasive action. With an SDM, on the other hand, the speed of closing is in the range of Mach 0.1 to Mach 0.5 so that the SDM poses a continued problem to the threat aircraft, continuing to take a collision course despite evasive actions short of breaking off pursuit or the expenditure of an offensive missile.

The presently envisioned preferred embodiment of the missile itself is shown in FIGS. 3A, 3B, and 3C. The self defense missile (SDM) assembly 20 comprises a body assembly 22, wings 24, vertical stabilizer 26 with steering means therein, and horizontal stabilizers 28 with steering means therein. The body assembly 22 is comprised of a warhead 30, a wing fold section 32, a guidance section 34, a fusing section 36, a control section 38, and a target detector 40. The segments 30 through 40 are interconnected through raceway 42. Pylon attachments 44 are provided for holding and releasing the SDM from the aircraft. The function of the segments 30 through 40 and the methods of operation thereof are substantially conventional in nature and according to techniques well known in the art. The point of novelty in construction of the SDM is the elimination of a propulsion package, the addition of wings 24, and the location of the target detector 40. As depicted in FIGS. 3A and 3B, the SDM 20 is moving in the direction of arrow A. In a conventional missile, the target detector (which is of the infrared or similar variety) is located in the extreme nose of the missile such as in the aerodynamic nosecone portion 46 of the warhead 30 of FIGS. 3A and 3B. The target detector looks where it is going in a positive sense since the conventional missile closes on its target in the direction in which it is travelling. By contrast, the SDM has the target detector 40 placed in the directly opposite end from the conventional missile. In the SDM the target detector still looks where it is going, but in a negative sense since it is closing on its target by allowing the target to overtake it.

In its preferred embodiment, the wings 24 are foldable to the ghost position 24' for ease of storage in the aircraft. The wings could be fixed position as well with the attendant elimination of the wing fold section 32. Likewise, steerable vertical and horizontal stabilizers 26 and 28 which respond to control section 38 to steer the SDM 20 can be replaced with other conventional methods of steering aircraft.

FIG. 4 and FIG. 5 depict the guidance and control concept and sequence of events in an SDM intercept sequence starting with detection of the threat 14 by the threat detection radar 50 of bomber 12. Following an initial tracking period, the SDM 10 is launched at approximately 45 degrees to the most likely intercept point as predicted by the bomber's fire control system 52 from the radar range, range rate, and line-of-sight angles. Launch is always parallel to the bomber's velocity vector. After separation, the SDM 10 is programmed to turn 45 degrees to the left. At this point the SDM is still under control of the bomber 12. Both the threat 14 and the SDM 10 are tracked by the bomber 12 and commands 54 are sent from the command transmitter 56 in the bomber 12 to the command receiver 58 in the SDM 10.

Due to the large volume of uncertainty as to where the target lies, the SDM 10 must be sent updated vehicle steering and sensor aiming instructions. FIG. 5 shows the flight path changes commanded more than ten seconds after launch as the flight path of threat 14 becomes evident. As the separation distance between the SDM 10 and the threat 14 approaches 2 n.m., the terminal guidance seeker (typically infrared tracking sensor 60) searches for the target in the designated zone. After lockon by the infrared tracking sensor 60 to infrared radiations 62 from threat 14, the SDM 10 steers by proportional navigation to an intercept. For the example and assumptions shown on FIG. 5, all intercepts occur before the postulated interceptor launch point of 2.2 n.m. slant range.

In addition to the preferred embodiment as shown and described above, certain options can be employed to fulfill the objective of the SDM—defense of the bomber. In one alternate embodiment, a small short duration power boost can be provided to modify the closing rate near final intercept. That is, put on the brakes, to to speak, so as to drive the SDM into the threat. Additionally, decoy options can be added to cause the threat aircraft to abandon the bomber in favor of pursuit of the SDM or decoy fired missiles. A radar corner reflector or a radar beacon can be installed on the SDM to decoy radar guided missiles. An infrared source which operates in the 4 to 5 micron wavelength band can be installed to decoy IR threat missiles. A modulated IR source can also be used as an IR countermeasure.

Having thus described my invention, I claim:

1. A self defense air-to-air missile comprising:

a) an aerodynamically shaped body, said body having a forward end, a middle portion, and an aft end, said body containing an explosive warhead, fuzing means operatively connected to said warhead for detonating said warhead, target detecting means being disposed within the aft end of said body and being further disposed to be responsive to targets located substantially aft of said missile, guidance means responsive to said target detecting means, and control means responsive to said guidance means;

b) a wing operably attached to said body and having lift sufficient to support said missile when said missile is moving in the forward direction relative to the surrounding air; and, c) vertical and horizontal stabilizing and steering means operably attached to said body and being responsive singly and in combination to said control means, whereby said missile can be made to fly in a straight line or made to change direction.

2. A self defense air-to-air missile as claimed in claim 1 wherein additionally:

a) said body contains wing folding means; and, b) said wing is operably attached to said body with said wing folding means whereby said wing can be folded close adjacent said body when said missile is stored and can be unfolded to an operational position for flying said missile.

3. A self defense air-to-air missile as claimed in claim 1 wherein additionally:

said guidance means is additionally responsive to signals from an aircraft which launched said missile in self defense.

4. A self defense air-to-air missile as claimed in claim 1 wherein additionally:

said body is provided with a short duration power boost means responsive to said target detecting mean, said power boost means providing a thrust in the aft direction when activated to rapidly slow said missile and thereby increase its speed of closing to an overtaking target.

5. A self defense air-to-air missile as claimed in claim 1 wherein additionally:

said missile is provided with signal directing means responsive to attacking aircraft electronic instrumentation whereby said electronic instrumentation of said attacking aircraft is decoyed from the defending aircraft launching said self defense air-to-air missile to said missile.

* * * * *